US009400452B2

(12) United States Patent
Ozeki

(10) Patent No.: US 9,400,452 B2
(45) Date of Patent: Jul. 26, 2016

(54) IMAGE FORMING UNIT HAVING IMAGE CARRIER, DEVELOPER CARRIER THAT SUPPLIES DEVELOPER TO IMAGE CARRIER AND DEVELOPER SUPPLY MEMBER THAT SUPPLIES DEVELOPER TO DEVELOPER CARRIER, AND IMAGE FORMING APPARATUS HAVING IMAGE CARRIER, DEVELOPER CARRIER THAT SUPPLIES DEVELOPER TO IMAGE CARRIER AND DEVELOPER SUPPLY MEMBER THAT SUPPLIES DEVELOPER TO DEVELOPER CARRIER

(71) Applicant: Oki Data Corporation, Tokyo (JP)

(72) Inventor: Fumitaka Ozeki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/608,871

(22) Filed: Jan. 29, 2015

(65) Prior Publication Data

US 2015/0220023 A1 Aug. 6, 2015

(30) Foreign Application Priority Data

Jan. 31, 2014 (JP) ..... 2014-017364

(51) Int. Cl.
*G03G 15/08* (2006.01)

(52) U.S. Cl.
CPC ..... *G03G 15/0898* (2013.01); *G03G 15/0815* (2013.01)

(58) Field of Classification Search
CPC G03G 15/08; G03G 15/0812; G03G 15/0806
See application file for complete search history.

(56) References Cited

U.S. PATENT DOCUMENTS

| | | | | |
|---|---|---|---|---|
| 6,212,348 | B1 * | 4/2001 | Inoue et al. | 399/284 |
| 6,353,720 | B1 * | 3/2002 | Sakai et al. | 399/234 |
| 2001/0026715 | A1 * | 10/2001 | Tatsumi | 399/284 |
| 2003/0235438 | A1 * | 12/2003 | Tatsumi | 399/284 |
| 2008/0159790 | A1 * | 7/2008 | Kikuchi | 399/260 |
| 2008/0298852 | A1 * | 12/2008 | Yamada | 399/279 |
| 2009/0041511 | A1 * | 2/2009 | Fuwa et al. | 399/284 |
| 2009/0245882 | A1 * | 10/2009 | Ozeki et al. | 399/260 |
| 2010/0028057 | A1 * | 2/2010 | Yamada et al. | 399/284 |

FOREIGN PATENT DOCUMENTS

JP H10-39628 A 2/1998

* cited by examiner

*Primary Examiner* — Clayton E LaBalle
*Assistant Examiner* — Ruifeng Pu
(74) *Attorney, Agent, or Firm* — Muncy, Geissler, Olds & Lowe, P.C.

(57) ABSTRACT

An image forming unit includes a first developer supply member that is arranged inside a developer container and supplies a developer to a developer carrier, a seal member of which a fixed end is fixed on a case.

The case has a first wall part that extends from the fixed end obliquely downward with respect to a vertical direction and a second wall part that continues from the first wall part and extends along an outer peripheral surface of the first developer supply member, and a first distance between an inner peripheral surface of the first wall part and the outer peripheral surface of the first developer supply member becomes smaller with increasing distance from the fixed end of the seal member.

17 Claims, 4 Drawing Sheets

IMAGE FORMING UNIT HAVING IMAGE CARRIER, DEVELOPER CARRIER THAT SUPPLIES DEVELOPER TO IMAGE CARRIER AND DEVELOPER SUPPLY MEMBER THAT SUPPLIES DEVELOPER TO DEVELOPER CARRIER, AND IMAGE FORMING APPARATUS HAVING IMAGE CARRIER, DEVELOPER CARRIER THAT SUPPLIES DEVELOPER TO IMAGE CARRIER AND DEVELOPER SUPPLY MEMBER THAT SUPPLIES DEVELOPER TO DEVELOPER CARRIER

CROSS REFERENCE

The present application is related to, claims priority from and incorporates by reference Japanese Patent Application No. 2014-017364, filed on Jan. 31, 2014.

TECHNICAL FIELD

The present invention relates to an image forming unit and an image forming apparatus.

BACKGROUND

Conventionally, in an image forming apparatus such as a printer, a copying machine, a facsimile, a multifunction machine, for example, in a printer, an image forming unit, an LED head, a transfer roller, a fuser, a sheet cassette, and the like, are arranged. The image forming unit includes a photosensitive drum, a charging roller, a development roller, a development blade, a toner supply roller, a cleaning blade, and the like.

In the image forming unit, a surface of the photosensitive drum that is uniformly charged by the charging roller is exposed by the LED head and an electrostatic latent image is formed. Further, a toner as a developer that is contained in a toner container as a developer container that is formed inside a case of the image forming unit is supplied to the development roller by the toner supply roller, and the development blade causes the toner on the development roller to form a thin layer. Next, the toner on the development roller is attached to the electrostatic latent image on the surface of the photosensitive drum, and the electrostatic latent image is developed and a toner image is formed on the photosensitive drum.

A sheet fed out from the sheet cassette is carried to a transfer part that is formed between the photosensitive drum and the transfer roller, and, after the toner image is transferred by the transfer roller at the transfer part, is carried to the fuser. At the fuser, the toner image is fused and an image is formed. Toner remained on the photosensitive drum after the transfer is removed by the cleaning blade.

The photosensitive drum and the development roller are in contact with each other at a contact part, and the development roller and the toner supply roller are in contact with each other at a nip part. The toner is supplied by the toner supply roller to the development roller at the nip part and the toner on the development roller is supplied to the electrostatic latent image on the surface of the photosensitive drum at the contact part (for example, see Japanese Patent Laid-Open Publication No. H10-39628).

However, in the above-described conventional image forming unit, the toner in the toner container is likely to stagnate and image quality may deteriorate due to the stagnation of the toner.

A purpose of the present invention is to solve the above-described problem of the conventional image forming unit to provide an image forming unit and an image forming apparatus that allow occurrence of stagnation of a developer in a developer container to be prevented and image quality to be improved.

SUMMARY

Therefore, an image forming unit of the present invention includes: an image carrier; a developer carrier that is arranged inside a developer container that contains a developer, and forms a developer image by attaching the developer to an electrostatic latent image on a surface of the image carrier; a first developer supply member that is arranged inside the developer container and supplies the developer to the developer carrier; and a seal member that has a fixed end and a free end, and prevents the developer inside the developer container from leaking out.

The fixed end of the seal member is fixed on a case that forms the developer container, and the free end of the seal member is in contact with the developer carrier at a position in a rotation direction of the developer carrier between a first contact part at which the image carrier and the developer carrier are in contact with each other and a second contact part at which the developer carrier and the first developer supply member are in contact with each other.

Further, the case has a first wall part that extends from the fixed end of the seal member obliquely downward with respect to a vertical direction and a second wall part that continues from the first wall part and extends along an outer peripheral surface of the first developer supply member.

Further, a first distance between an inner peripheral surface of the first wall part and the outer peripheral surface of the first developer supply member becomes smaller with increasing distance from the fixed end of the seal member.

In this case, the case has the first wall part that extends from the fixed end of the seal member obliquely downward with respect to the vertical direction and the second wall part that continues from the first wall part and extends along the outer peripheral surface of the first developer supply member, and the first distance between the inner peripheral surface of the first wall part and the outer peripheral surface of the first developer supply member becomes smaller as a distance from the fixed end of the seal member increases. Therefore, developer scraped off by the first developer supply member from the developer carrier is more strongly pressed against the first developer supply member when the developer is carried to a more downstream side in a rotation direction of the first developer supply member.

Therefore, since a filling rate of the developer on the first developer supply member for the developer carrier is increased, a carrying amount of the developer per unit volume can be increased and occurrence of stagnation of the developer inside the developer container can be prevented. As a result, image quality can be improved.

DETAILED EMBODIMENTS

In the following, an embodiment of the present invention is described in detail with reference to the drawings. In this case, a printer as an image forming apparatus is described.

Figure 2:
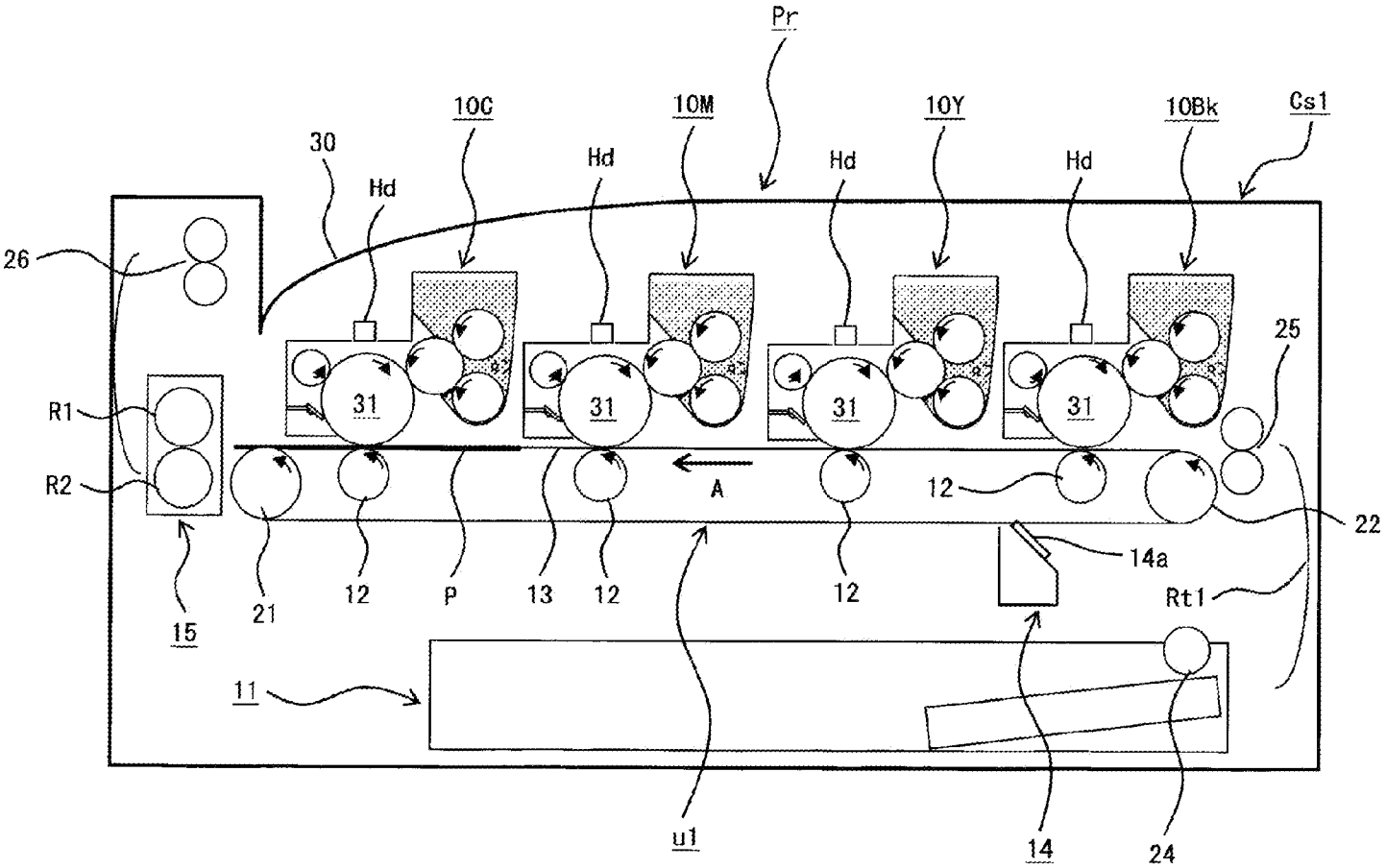
FIG. 2 illustrates a conceptual diagram of a printer according to the embodiment of the present invention.

FIG. 2 illustrates a conceptual diagram of a printer in an embodiment of the present invention.

In FIG. 2, Pr indicates a printer; Cs1 indicates a case of the printer Pr; 10Bk, 10Y, 10M, 10C respectively indicate image forming units that are arranged on an upper side inside the case Cs1 and respectively form toner images as developer images of respective colors including black, yellow, magenta and cyan; u1 indicates a transfer unit that is arranged below the image forming units 10Bk, 10Y, 10M, 10C, sequentially transfers the toner images of the respective colors that are respectively formed by the image forming units 10Bk, 10Y, 10M, 10C to a sheet P as a medium, and forms a color toner image; 11 indicates a sheet cassette as a medium housing part that is arranged below the transfer unit u1 and contains the sheet P; 15 indicates a fuser as a fuser device that fuses the color toner image transferred to the sheet P to form a color image; 24 indicates a feeding-out roller that separates one by one the sheet P that is contained in the sheet cassette 11 and feeds out the sheet P to a medium carrying route Rt1; 25 indicates a registration roller pair that corrects a skew of the sheet P that is fed out by the feeding-out roller 24; 26 indicates an ejection roller pair that ejects the sheet P on which the color image is formed to outside of a body of the printer Pr, that is, to outside of an apparatus body; and 30 indicates a stacker as a medium stacking part that is formed on a top wall of the case Cs1 and stacks the sheet P that is ejected by the ejection roller pair 26.

Further, 31 indicates a photosensitive drum as an image carrier that is arranged in each of the image forming units 10Bk, 10Y, 10M, 10C; and Hd indicates an LED head as an exposure device that is arranged above the photosensitive drum 31 in each of the image forming units 10Bk, 10Y, 10M, 10C in a manner opposing the photosensitive drum 31.

The transfer unit u1 includes: a drive roller 21 as a first roller that is rotatably arranged on a downstream side in a carrying direction of the sheet P and is rotated by receiving rotation transmitted from a belt motor (not illustrated in FIG. 2) as a drive part for moving; an idle roller 22 as a second roller that is rotatably arranged on an upstream side in the carrying direction of the sheet P and rotates along with the rotation of the drive roller 21; a transfer belt 13 that is stretched over the drive roller 21 and the idle roller 22, moves along with the rotation of the drive roller 21 in an arrow A direction, and carries the sheet P; transfer rollers 12 as transfer members that are arranged in a manner respectively opposing the photosensitive drums 31 via the transfer belt 13 and transfer the toner images that are formed on surfaces of the photosensitive drums 31 to the sheet P; a cleaning device 14 that removes toner attached to the transfer belt 13; and the like. The transfer rollers 12 are each formed from a foamed elastic body. A transfer part is formed between a photosensitive drum 31 and a transfer roller 12.

The cleaning device 14 includes a cleaning blade 14*a* as a cleaning member that is arranged in such a manner that a front end thereof is brought into contact with the transfer belt 13 in a direction opposite to a moving direction of the transfer belt 13.

The fuser 15 includes a heat application roller R1 as a first fuser member and a pressure application roller R2 as a second fuser member. A heat application element (not illustrated in FIG. 2) is arranged inside the heat application roller R1. The color toner image is heated by the heat application roller R1 and is pressed by the pressure application roller R2, and is fused on the sheet P.

Next, the image forming units 10Bk, 10Y, 10M, 10C are described. In this case, since the image forming units 10Bk, 10Y, 10M, 10C have the same structure, the image forming unit 10C is described.

Figure 3:
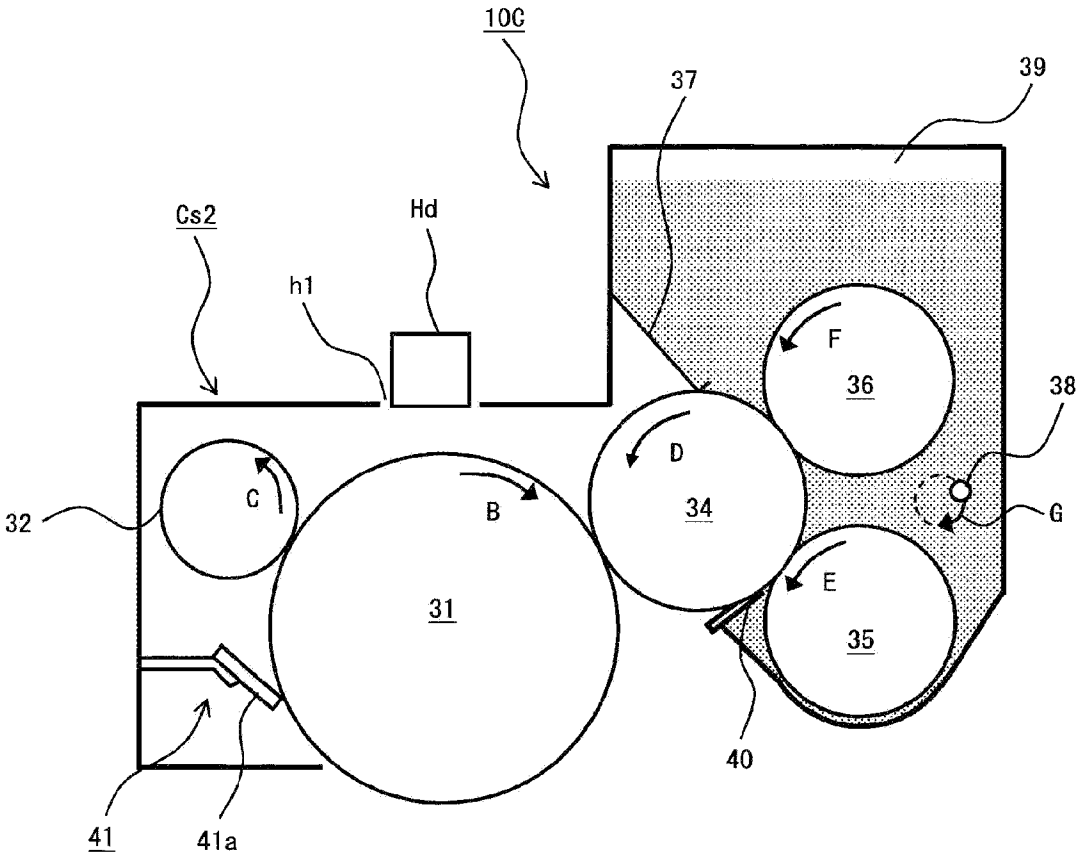
FIG. 3 illustrates a schematic diagram of an image forming unit according to the embodiment of the present invention.

FIG. 3 illustrates a schematic diagram of the image forming unit according to the embodiment of the present invention.

In FIG. 3, 10C indicates the image forming unit; Cs2 indicates a case of the image forming unit 10C; hl indicates an opening formed on the case Cs2; and Hd indicates the LED head. The LED head Hd is adjacent to the image forming unit 10C and is arranged above the photosensitive drum 31 to oppose the photosensitive drum 31 via the opening hl. The LED head Hd includes LED elements (not illustrated in the drawings) as light emitting elements, a drive element (not illustrated in the drawings) that drives the LED elements to emit light, a lens array (not illustrated in the drawings) that collects light emitted by the LED elements to form an image on the surface of the photosensitive drum 31, and the like.

Further, 32 indicates a charging roller as a charging device that is rotatably arranged to be in contact with the photosensitive drum 31; 34 indicates a development roller as a developer carrier that is rotatably arranged to be in contact with the photosensitive drum 31; 35 indicates a first toner supply roller as a first developer supply member and as a first developer supply roller that is rotatably arranged to be in contact with the development roller 34; 36 indicates a second toner supply roller as a second developer supply member and as a second developer supply roller that is rotatably arranged to be in contact with the development roller 34; 37 indicates a development blade as a developer regulating member that is attached to a predetermined place of the case Cs2 and is arranged in such a manner that a front end thereof is in contact with the development roller 34; 38 indicates an agitation member that is rotatably arranged between the first and second toner supply rollers 35, 36 in a height direction of the image forming unit 10C in a manner opposing the first and second toner supply rollers 35, 36; 39 indicates a toner container as a developer container that is formed inside the case Cs2 and contains toner as developer; 40 indicates a toner leakage prevention film as a seal member that is attached to a predetermined place of the case Cs2 and is arranged in such a manner that a front end thereof is brought into contact with the development roller 34 in a forward direction with respect to a rotation direction of the development roller 34 to prevent toner inside the toner container 39 from leaking out to outside of the case Cs2; and 41 indicates a cleaning device that removes toner that is remained on the photosensitive drum 31 after the transfer of the toner image. The cleaning device 41 includes a cleaning blade 41*a* as a cleaning member that is arranged in such a manner that a front end thereof is brought into contact with the photosensitive drum 31 in a direction opposite to a rotation direction of the photosensitive drum 31.

The toner container 39 is surrounded by the case Cs2, the development blade 37, the development roller 34 and the toner leakage prevention film 40.

The photosensitive drum 31 rotates in an arrow B direction; the charging roller 32 rotates in an arrow C direction (opposite direction of the photosensitive drum 31); the development roller 34 rotates in an arrow D direction (opposite direction of the photosensitive drum 31); the first and second toner supply rollers 35, 36 respectively rotate in an arrow E direction and an arrow F direction (which are the same direction as the development roller 34); and the agitation member 38 rotates in an arrow G direction (opposite direction of the first and second toner supply rollers 35, 36).

Therefore, on one end of the photosensitive drum 31, a drum drive gear (not illustrated in the drawings) is attached, and the drum drive gear and a drum motor (not illustrated in the drawings) as a drive part are linked by a gear train. Rotation generated by driving the drum motor is transmitted via the gear train to the drum drive gear and the photosensitive drum 31 is rotated.

Further, the charging roller 32 is rotated by friction with the surface of the photosensitive drum 31; the development roller 34 is rotated by engaging a development roller gear (not illustrated in the drawings) that is attached to one end of the development roller 34 with the drum drive gear; the first toner supply roller 35 is rotated by engaging a first toner supply roller gear (not illustrated in the drawings) that is attached to one end of the first toner supply roller 35 with the drum drive gear via an idle gear (not illustrated in the drawings); and the second toner supply roller 36 is rotated by engaging a second toner supply roller gear (not illustrated in the drawings) that is attached to one end of the second toner supply roller 36 with the development roller gear via an idle gear (not illustrated in the drawings).

The photosensitive drum 31 has an aluminum tube that has a thickness of 0.75 [mm] and an outer diameter of 30 [mm], and a charge generation layer of a thickness of 0.5 [μm] and a charge transportation layer of a thickness of 20 [μm] that are formed on the aluminum tube.

Further, the charging roller 32 has a shaft of a conductor that is formed from, for example, an SUS (stainless steel) material and a conductive elastic body such as epichlorohydrin that is coated on the shaft, and uniformly charges the surface of the photosensitive drum 31. The LED head Hd exposes the surface of the photosensitive drum 31 that is uniformly charged, and forms an electrostatic latent image as a latent image.

The development roller 34 has a conductive shaft (core shaft) that is formed from as SUS material, a roll-shaped elastic layer that is provided on the conductive shaft, and a surface layer that is coated on the elastic layer, and attaches toner to the electrostatic latent image on the surface of the photosensitive drum 31 to form a toner image. The elastic layer is formed using a urethane rubber, a silicon rubber or the like. The surface layer is formed by processing the urethane rubber using a urethane solution and applying a resin such as an acrylic resin, an acrylic-fluorine copolymer resin, or the like to the elastic layer. In order to impart conductivity to the surface layer, carbon black is added to the resin such as an acrylic resin, an acrylic-fluorine copolymer resin, or the like.

Further, the first and second toner supply rollers 35, 36 each have a conductive shaft (core shaft) that is formed from an SUS material and an elastic layer that is provided on the conductive shaft, supply toner to the development roller 34 while frictionally charging the toner. The elastic layer is formed by a semiconductive silicon rubber foam, a semiconductive urethane rubber foam, or the like. In order to impart semiconductivity to the elastic layer, acetylene black, carbon black or the like is added to a silicon rubber foam, a urethane rubber foam, or the like.

The development blade 37 is formed using a plate that is made of an SUS material having a plate thickness of 0.08 [mm], and a portion thereof that is in contact with the development roller 34 is subjected to bending processing so that a bent part having a curvature radius R of 0.2 [mm] is formed. The development blade 37 is brought into contact with the development roller 34 at a linear pressure of 30 [gf/cm] causing the toner on the development roller 34 to form a thin layer, and a thin layer of toner is formed on the development roller 34. The curvature radius R of the bent part and the linear pressure are adjusted according to an amount of the toner on the development roller 34, a charge amount of the toner, and the like.

The agitation member 38 is formed using a rod that is made of an SUS material having a diameter of 1.5 [mm].

In this case, the first and second toner supply rollers 35, 36 are in contact with the development roller 34. Therefore, even when a portion of the surface of the development roller 34 where the toner becomes less due to development being performed reaches a nip part Np1 (FIG. 1) (to be described later) between the development roller 34 and the first toner supply roller 35, toner is further supplied from the second toner supply roller 36 to the development roller 34 at a nip part Np2 between the development roller 34 and the second toner supply roller 36. Therefore, occurrence of a density difference between a first half region and a second half region of the sheet P in the carrying direction of the sheet P can be prevented.

Next, operation of the printer Pr of the above-described configuration is described.

First, upon receiving a print command, a controller (not illustrated in the drawings) applies a charging voltage to the charging rollers 32 to uniformly charge the surfaces of the photosensitive drums 31 and thereafter drives the LED heads Hd according to image data to form electrostatic latent images of predetermined patterns on the surfaces of the photosensitive drums 31.

Next, the controller applies a supply voltage to the first and second toner supply rollers 35, 36 and a blade voltage to the development blades 37, and uniformly forms thin layers of toner on the development rollers 34 and causes the thin layers of the toner to have a charge amount of a predetermined value. Next, the controller applies a development voltage to the development rollers 34, on the surfaces of which the thin layers of toner are formed, to attach toner to the electrostatic latent images on the surfaces of the photosensitive drums 31 to develop the electrostatic latent images.

Next, the controller causes the feeding-out roller 24 (FIG. 2) to rotate to separate one by one the sheet P contained in the sheet cassette 11 and carry the sheet P to the medium carrying route Rt1, corrects a skew of the sheet P using the registration roller pair 25, and carries the sheet P to the respective transfer parts between the photosensitive drums 31 and the transfer rollers 12.

Further, the controller applies a transfer voltage to the transfer rollers 12, drives the belt motor to rotate the drive roller 21 to cause the transfer belt 13 to move to carry the sheet P, and sequentially superimpose and transfer the toner images on the surfaces of the photosensitive drums 31 to the sheet P at the respective transfer parts to form a color toner image. Toner remained on the photosensitive drums 31 after the transfer is removed by the cleaning device 41.

Next, the controller carries the sheet P, on which the color toner image is formed, to the fuser 15 and, in the fuser 15, causes the color toner image to be fused on the sheet P to form a color image. Next, the controller causes the ejection roller pair 26 to rotate and thereby ejects the sheet P to outside of the apparatus body to be stacked on the stacker 30.

When the printer Pr is operated in an environment of normal temperature and normal humidity using a negatively chargeable toner, for example, the charging voltage applied to the charging roller 32 is set to −1050 [V]; the development voltage applied to the development roller 34 is set to −200

[V]; the supply voltage applied to the first and second toner supply rollers 35, 36 is set to −300 [V]; and the blade voltage applied to the development blade 37 is set to −300 [V].

When a charging voltage of above a predetermined value is applied to the charging rollers 32, the surfaces of the photosensitive drums 31 are charged, and a surface potential of the photosensitive drums 31 varies in proportion to the charging voltage applied to the charging rollers 32. In the present embodiment, the charging voltage applied to the charging rollers 32 is set to −1050 [V]. Therefore, the surface potential of the photosensitive drums 31 is −500 [V]. Then, a latent image potential of the electrostatic latent images that are formed by driving the LED heads Hd is −50 [V], the toner on the development rollers 34 is attached to the electrostatic latent images, and reverse development is performed. When a positively chargeable toner is used, the polarities of the respective voltages are reversed.

However, when toner stagnates inside the toner container 39 and toner cannot be sufficiently supplied to a space between the first and second toner supply rollers 35, 36 inside the toner container 39, a thin layer of toner cannot be stably formed on the development roller 34, and blurring and the like in an image occurs and image quality deteriorates.

Therefore, in the present embodiment, at predetermined positions inside the toner container 39, the first and second toner supply rollers 35, 36 and the agitation member 38 are arranged to prevent stagnation of the toner inside the toner container 39.

Figure 1:
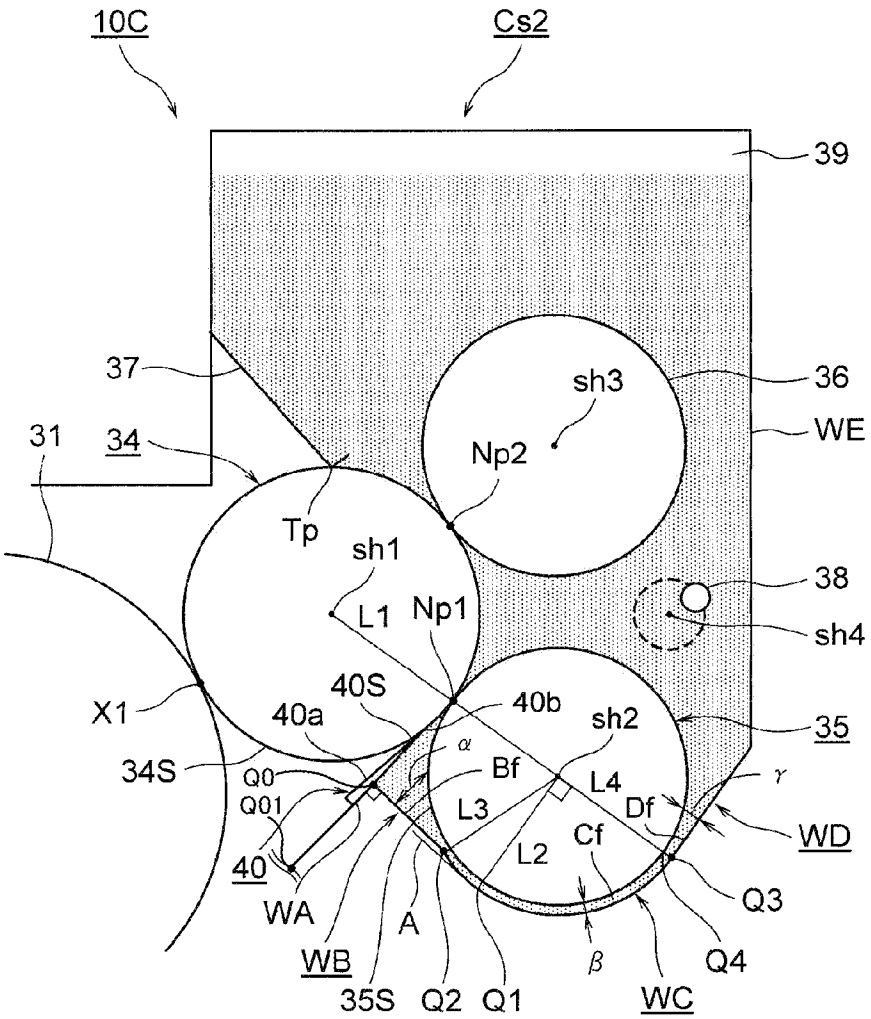
FIG. 1 illustrates a first diagram of an image forming unit according to an embodiment of the present invention.
Figure 4:
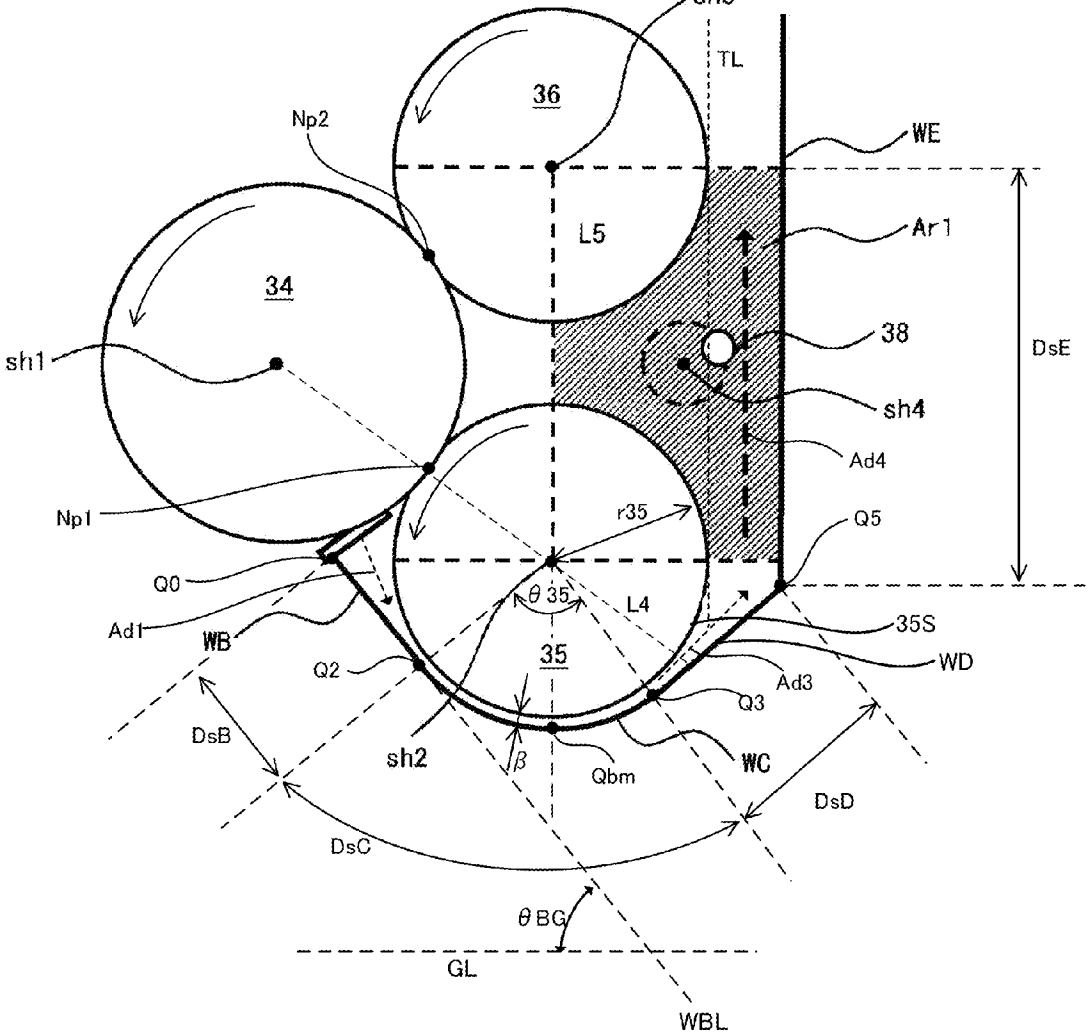
FIG. 4 illustrates a second diagram of the image forming unit according to the embodiment of the present invention.

FIG. 1 illustrates a first diagram illustrating main parts of the image forming unit according to the embodiment of the present invention; and FIG. 4 illustrates a second diagram illustrating the main parts of the image forming unit according to the embodiment of the present invention. Also in this case, the image forming unit 10C of the image forming units 10Bk, 10Y, 10M, 10C is described.

In FIGS. 1 and 4, Cs2 indicates the case of the image forming unit 10C; 31 indicates the photosensitive drum; 34 indicates the development roller; 35 indicates the first toner supply roller; 36 indicates the second toner supply roller; 37 indicates the development blade; 38 indicates the agitation member; 39 indicates the toner container; and 40 indicates the toner leakage prevention film. The photosensitive drum 31 and the development roller 34 are in contact with each other at a contact part X1 as a first contact part; the development roller 34 and the first toner supply roller 35 are in contact with each other at a nip part Np1 as a second contact part; the development roller 34 and the second toner supply roller 36 are in contact with each other at a nip part Np2 as a third contact part; and the development blade 37 and the development roller 34 are in contact with each other at a pressing part Tp as a fourth contact part. Further, sh1-sh4 indicate rotation centers of the development roller 34, the first and second toner supply rollers 35, 36 and the agitation member 38.

In order to form the toner container 39, the case Cs2 includes wall parts WA-WE. In the present embodiment, the wall part WB configures a first wall part; the wall part WC configures a second wall part; the wall part WD configures a third wall part; and the wall part WA configures a fourth wall part.

(Wall Part WA)

The wall part WA is formed on an opposite side of the pressing part Tp across the rotation center sh1 of the development roller 34 and on a lower side of the development roller 34 in a vertical direction. The toner leakage prevention film 40 is attached to the wall part WA. The toner leakage prevention film 40 extends toward the nip part Np1 between the development roller 34 and the first toner supply roller 35, having a portion, that is, an attachment part as a fixed end 40*a* that is attached to the wall part WA and a front end as free end 40*b*. The free end 40*b* is in contact with the development roller 34 at a position between the contact part X1 and the nip part Np1 in the rotation direction of the development roller 34. That is, a contact surface 40S of the toner leakage prevention film 40 and an outer peripheral surface 34S of the development roller 34 are in contact with each other.

As illustrated in FIG. 1, the wall part WA is defined as a wall from point Q01 to point Q0. The point Q0 is a tip of corner made with the wall part WA and a wall part WB that is discussed below. The point Q01 is expedient to simply FIG. 1. The toner leakage prevention film 40 is arranged along the wall part WA and projects from the point Q0 toward the nip part Np1.

(Wall Part WB as First Wall Part)

The wall part WB is formed continuing from the wall part WA and substantially linearly extends in a direction that forms a predetermined angle with respect to the wall part WA, that is, in the present embodiment, a direction that is substantially orthogonal with respect to the wall part WA (the wall part WB and the wall part WA form an angle of 80-100 [°] with respect to each other). When a line connecting the rotation center sh1 of the development roller 34 and the rotation center sh2 of the first toner supply roller 35 is L1 and a line orthogonal to the line L1, which passes on the rotation center sh2, is L2, the wall part WB extends in a manner downwardly inclined from the fixed end 40*a* to a point Q2 that is more on the fixed end 40*a* side than a point Q1 at which the line L2 and the case Cs2 intersects (becomes lower in the vertical direction with increasing distance from the fixed end 40*a*) and in a manner parallel to an outer-circumference tangent line of the first toner supply roller 35 at a predetermined point. When a line connecting the rotation center sh2 of the first toner supply roller 35 and the point Q2 is L3, a distance on the line L2 between the rotation center sh2 and the point Q1 and a distance on the line L3 between the rotation center sh2 and the point Q2 are equal.

A first distance "α" between an inner peripheral surface Bf of the wall part WB and an outer peripheral surface 35S of the first toner supply roller 35 in a direction orthogonal to the inner peripheral surface Bf of the wall part WB becomes smaller as a distance from the fixed end 40*a* increases. The first distance α is defined by the wall part WB.

In the present embodiment, the wall part WB substantially linearly extends. However, it is also possible that the wall part WB extends in a lightly curved manner. In this case, the wall part WB is bent at a curvature radius larger than a curvature radius of the outer peripheral surface 35S of the first toner supply roller 35, and the first distance α between the inner peripheral surface Bf of the wall part WB and the outer peripheral surface 35S of the first toner supply roller 35 becomes smaller with increasing distance from the fixed end 40*a*.

(Wall Part WC)

The wall part WC is formed continuing from the wall part WB. When a point at which a line L4 obtained by extending the line L1 obliquely downward and the case Cs2 intersect is Q3, the wall part WC extends from the point Q2 to the point Q3 below the first toner supply roller 35 in the vertical direction. The wall part WC is formed extending in an arc shape along the outer peripheral surface 35S of the first toner supply roller 35 in a manner maintaining a predetermined gap, that is, a gap of 0.5 [mm] in the present embodiment, and having a predetermined curvature radius. A second distance "β" between an inner peripheral surface Cf of the wall part WC and the outer peripheral surface 35S of the first toner supply roller 35 is equal to or less than the first distance α between the wall part WB and the outer peripheral surface 35S of the first toner supply roller 35. The second distance β is defined by the wall part WC. At the point Q2, the first distance α and the second distance β is equal.

Where a radius of the first toner supply roller 35 is denoted by r35 (see FIG. 4), the wall part WC is defined as an arc around the point sh2 having a radius (r35+distance β).

In this case, the wall part WB linearly extends from the fixed end 40*a* to the point Q2, and the wall part WC extends in an arc shape from the point Q2 to the point Q3, the point Q2 being positioned more on the fixed end 40*a* side than the point Q1. Therefore, when a plane that is substantially parallel to the wall part WB and is in contact with the wall part WC is a virtual plane A, the wall part WB is formed extending more on the nip part Np1 side than the virtual plane A. Then, at the point Q2, the wall parts WB, WC intersect at a predetermined angle forming a projecting part that slightly projects toward the first toner supply roller 35. Further, a slope of a portion of the wall part WC at the point Q2 with respect to the vertical direction is larger than a slope of the wall part WB, and a slope shape is formed in the wall part WC, the slope shape beginning at the point Q2.

The wall part WB can be arranged on a tangent line that is drawn from the wall part WC, parallel to the wall part WB. However, in the embodiment, the wall part WB is arranged closer to the point sh2 than the tangent line, which is parallel to the wall part WB. Thereby, at the point Q2 that is an intersection between the wall parts WB and WC, the projecting part is formed. The point Q2 may be called an end of the wall part WB that is straight, and a beginning of the curved wall part WC.

In the drawing view of FIG. 1, the projecting part at point Q2 is located at about 135 degrees around the point sh2, assuming the top of the first toner roller 35 located at 0 degree. The projecting part may be located within a range from 210 degrees to 240 degrees.

(Wall Part WD)

The wall part WD is formed continuing from the wall part WC from the point Q3 on an opposite side of a side of the wall part WC on which the wall part WB is formed, and extends substantially in parallel to an outer-circumference tangent line at an intersection point (point Q4) between the outer peripheral surface 35S of the first toner supply roller 35 and the line L4 and substantially linearly. A third distance "γ" between an inner peripheral surface Df of the wall part WD and the outer peripheral surface 35S of the first toner supply roller 35 in a direction orthogonal to the inner peripheral surface Df of the wall part WD becomes larger as a distance from the point Q3 increases. Further, the wall part WD extends in a manner upwardly inclined from the point Q3 (becomes higher in the vertical direction with increasing distance from the point Q3). The third distance γ is defined by the wall part WD. Further, the inner peripheral surface Df of the wall part WD forms a plane that contains a tangent line of the inner peripheral surface Cf of the wall part WC.

(Wall Part WE)

The wall part WE is formed continuing from the wall part WD extending upward from an upper end of the wall part WD in the vertical direction.

In the image forming unit 10C of the above-described configuration, toner on the development roller 34 that is not used for development is first scraped off by the first toner supply roller 35. The scraped-off toner passes through between the outer peripheral surface 35S of the first toner supply roller 35 and the wall parts WA-WC along with the rotation of the first toner supply roller 35, and is carried to the point Q3.

(Distance β)

Here, as described above, in the present embodiment, the second distance β between the wall part WC and the outer peripheral surface 35S of the first toner supply roller 35 is equal to or smaller than the first distance a between the wall part WB and the outer peripheral surface 35S of the first toner supply roller 35, and the first distance α becomes smaller with increasing distance from the fixed end 40*a*. Therefore, the toner scraped off by the first toner supply roller 35 is more strongly pressed against the first toner supply roller 35 when it is carried to a more downstream side in the rotation direction of the first toner supply roller 35.

Therefore, since a filling rate of the toner on the first toner supply roller 35 for the development roller 34 is increased, a carrying amount of the toner per unit volume can be increased.

Further, the slope of the portion of the wall part WC at the point Q2 with respect to the vertical direction is larger than the slope of the wall part WB. Therefore, the toner that is carried between the wall part WB and the first toner supply roller 35 can be smoothly carried to between the wall part WC and the first toner supply roller 35.

Further, the wall part WD is formed continuing from the wall part WC at the point Q3, and the inner peripheral surface Df of the wall part WD forms a plane that contains a tangent line of the inner peripheral surface Cf of the wall part WC, the tangent line being drawn passing through the point Q3. Therefore, the toner that is carried to between the wall part WC and the first toner supply roller 35 can be carried toward the agitation member 38.

It is noted that, in FIG. 1, the point Q3 is positioned nearly on the line 4L. However, it is not necessary to be limited to that position. As shown in FIG. 4, the point Q3 may be positioned closer to a bottom of the wall part WC, which is lower than an intersection between the line L4 and the wall part WD.

However, in a vicinity of the wall part WE inside the toner container 39, toner is supplied from an upper side toward a down side and toner that is scraped off from the development roller 34 by the first toner supply roller 35 is supplied from the lower side toward the upper side. The toner is carried to a space between the first and second toner supply rollers 35, 36. The primary moving directions of toner are referred with dotted arrows Ad1, Ad3 and Ad4 in FIG. 4.

Therefore, in the present embodiment, as illustrated in FIG. 4, the agitation member 38 is arranged in a region Ar1 (see hatching area in FIG. 4) that is formed, in the vertical direction, above the rotation center sh2 of the first toner supply roller 35 and below the rotation center sh3 of the second toner supply roller 36 and, in a horizontal direction, is more on the wall part WE side than a line L5 that connects the rotation centers sh2, sh3, that is, on an opposite side of the development roller 34. In the present embodiment, the rotation center sh4 of the agitation member 38 is arranged at a position that is substantially at the same height as the rotation center sh1 of the development roller 34 and at the development roller 34 side rather than a common outer-circumference tangent line (TL) of the first and second toner supply rollers 35, 36.

In the embodiment, the agitation member 38 is in a bar shape that is arranged along the same direction as the rotation axes sh2, sh3 and designed to rotate around the rotation center sh4. Specifically, the bar extends from the front side to the back side of the drawing sheet. The designed rotation path of the bar is depicted with a dotted circle line around the rotation center sh4.

Below the region Ar1, as described above, the second distance β between the wall part WC and the outer peripheral surface 35S of the first toner supply roller 35 is smaller than the first distance α between the wall part WB and the outer peripheral surface 35S of the first toner supply roller 35. Therefore, without being carried downward, the toner moves toward the agitation member 38 along with the rotation of the first toner supply roller 35. Further, above the region Ar1, the toner inside the toner container 39 moves toward the agitation member 38 by its own weight.

In the present embodiment, the agitation member 38 rotates in an opposite direction of the first and second toner supply rollers 35, 36. Therefore, the agitation member 38 agitates the toner in a manner assisting a flow (Ad4) of the toner that is formed by the first and second toner supply rollers 35, 36, feeds the toner that is scraped off by the first toner supply roller 35 to the space between the first and second toner supply rollers 35, 36 and facilitates interchange between toner in a vicinity of the second toner supply roller 36 and the toner that moves by its own weight inside the toner container 39.

As described above, in the present embodiment, The case Cs2 includes the wall part WB that extends from the fixed end 40*a* of the seal member 40 substantially parallel to the outer-circumference tangent line of the first toner supply roller 35, and the wall part WC that continues from the wall part WB and extends along the outer peripheral surface 35S of the first toner supply roller 35. The first distance α between the inner peripheral surface Bf of the wall part WB and the outer peripheral surface 35S of the first toner supply roller 35 becomes smaller with increasing distance from the fixed end 40*a*. Therefore, the toner scraped off by the first toner supply roller 35 from the development roller 34 is more strongly pressed against the first toner supply roller 35 when the tone is carried to a more downstream side in the rotation direction of the first toner supply roller 35.

Therefore, since a filling rate of the toner on the first toner supply roller 35 for the development roller 34 is increased, a carrying amount of the toner per unit volume increases so that it becomes easy for the toner to move from the first toner supply roller 35 side toward the agitation member 38.

Thus, not only stagnation of the toner in the toner container 39 can be prevented, but also the toner can be sufficiently supplied to the space between the first and second toner supply rollers 35, 36. Therefore, a stable thin layer of toner can be formed on the development roller 34. As a result, blurring and the like in an image can be prevented from occurring, and image quality can be improved.

In the above embodiment, the printer Pr is described. However, the present invention can be applied to a copying machine, a facsimile, a multifunction machine, and the like.

The present invention is not limited to the above embodiment. Based on the spirit of the present invention, various modifications are possible, which are not to be excluded from the scope of the present invention.

(Preferred Spec.)

One of embodiments of the invention is realized with the following specs.

Length of wall part WB (DsB)=5.8 mm,
Length of wall part WC (DsC)=13.7 mm,
Length of wall part WD (DsD)=12.5 mm,
Length of wall part WE (DsE)=11.3 mm,
Radius of roller 35 (r35)=7 mm,
Second distance (β)=0.5 mm,
Angle corresponding to wall part WC (θ35)=102°.

Here are preferred ranges for the above.

Length of wall part WB (DsB) is within 4 to 10 mm;
Length of wall part WC (DsC) is within 8 to 15 mm;
Length of wall part WD (DsD) is within 8 to 15 mm;
Length of wall part WE (DsE) is at least 10 mm;
Radius of roller 35 (r35) is within 6 to 10 mm;
Second distance (β) is within 0.3 mm to 1.0 mm;
First distance (α) is within 0.3 to (r35−β);
Angle corresponding to wall part WC (θ35) is within 90° to 110°.
Regarding an inclination of the wall part WB, an angle (θ BG) of the wall part WB with respect to ground line GL is preferred to be within 30 to 50 degrees, see FIG. 4. The ground line GL means a horizontal line based on the ground.

What is claimed is:

1. An image forming unit, comprising:

an image carrier;

a developer carrier that is arranged inside a developer container that contains a developer, and forms a developer image by attaching the developer to an electrostatic latent image on a surface of the image carrier;

a first developer supply member that is arranged inside the developer container and supplies the developer to the developer carrier;

a seal member that has a fixed end and a free end, and prevents the developer inside the developer container from leaking out, wherein the fixed end of the seal member is fixed on a case that forms the developer container, and the free end of the seal member is in contact with a circumferential surface of the developer carrier at a position between a first position at which the developer carrier supplies the developer to the image carrier and a second position at which the first developer supply member supplies the developer to the developer carrier in a rotational direction of the developer carrier, the case has a first wall part having an inner surface that extends from the fixed end of the seal member obliquely downward with respect to a vertical direction and a second wall part having an inner surface that continues from the inner surface of the first wall part and extends along an outer peripheral surface of the first developer supply member, a first distance between the inner surface of the first wall part and the outer peripheral surface of the first developer supply member becomes smaller with increasing distance from the fixed end of the seal member, the inner surface of the first wall part is formed substantially planar, and when a plane that is substantially parallel to the inner surface of the first wall part and that is tangential to the inner surface of the second wall part is defined as a first virtual plane, a shortest distance between the inner surface of the first wall part and the second position is shorter than a shortest distance between the first virtual plane and the second position.

2. The image forming unit according to claim 1, wherein the inner surface of the first wall part substantially linearly extends.

3. An image forming apparatus, comprising:

the image forming unit according to claim 2, wherein the inner surface of the first wall part inclines by 30 to 50 degrees relative to a horizontal direction when the image forming unit is installed in the image forming apparatus.

4. The image forming unit according to claim 1, comprising:

a third wall part that is formed continuing from the second wall part from an opposite side of a side of the second wall part on which the first wall part is formed, wherein the third wall part has a surface that is tangential to the inner surface of the second wall part.

5. The image forming unit according to claim 4, further comprising:

a fourth wall part that continuously extends from the third wall part on an opposite side of a side on which the second wall part is formed, wherein the fourth wall part is formed to form a predetermined angle with the third wall part, and a length of the third wall part is 8 mm to 15 mm.

6. The image forming unit according to claim 1, comprising:

a second developer supply member that is provided inside the developer container and supplies the developer to the developer carrier, wherein the second developer supply member supplies the developer to the developer carrier at a third position, and the third position is on an upstream side than the first position and on a downstream side than the second position in a rotation direction of the developer carrier.

7. The image forming unit according to claim 6, wherein an agitation member that agitates the developer is arranged between a rotation center of the first developer supply member and a rotation center of the second developer supply member in the vertical direction, and when a second virtual plane that passes through the rotation center of the first developer supply member and the rotation center of the second developer supply member is referenced, the agitation member is arranged on an opposite side of the developer carrier relative to the second virtual plane.

8. The image forming unit according to claim 7, wherein the first developer supply member and the second developer supply member rotate in the same direction, and the agitation member rotates in an opposite direction of a rotational direction of the first developer supply member and a rotational direction of the second developer supply member.

9. The image forming unit according to claim 1, wherein the inner surface of the first wall part extends substantially parallel to an outer-circumference tangent line of the first developer supply member.

10. The image forming unit according to claim 1, wherein a second distance between the second wall part and the outer peripheral surface of the first developer supply member is equal to or smaller than the first distance.

11. The image forming unit according to claim 1, wherein the seal member is in contact with the developer carrier on a more downstream side than the first position and on a more upstream side than the second position in a rotation direction of the developer carrier.

12. An image forming apparatus, comprising:

a medium feeding unit that contains and feeds a medium, the image forming unit of claim 1, and a fuser unit that fuses an image, which is formed on the medium with the developer, with heat.

13. The image forming unit according to claim 1, further comprising:

a fourth wall part that extends from the first wall part on an opposite side of a side from which the second wall part extends, wherein an angle formed by the first wall part and the fourth wall part is substantially 90 degrees, and the fixed end of the seal member is arranged on the fourth wall part.

14. The image forming unit according to claim 1, wherein a distance between the fixed end of the seal member on the first wall part and the second wall part is 4 mm to 10 mm.

15. The image forming unit according to claim 1, wherein a length of the inner surface of the second wall part is 8 mm to 15 mm.

16. The image forming unit according to claim 1, wherein the developer carrier supplies the developer to the image carrier by contacting with the image carrier.

17. The image forming unit according to claim 1, wherein the developer carrier supplies the developer to the image carrier by contacting with the image carrier, and the first developer supply member supplies the developer to the developer carrier by contacting with the developer carrier.

* * * * *